US005333928A

United States Patent [19]

Rollinson

[11] Patent Number: 5,333,928

[45] Date of Patent: Aug. 2, 1994

[54] TABLE AND CHAIR ASSEMBLY

[76] Inventor: Michelle Rollinson, 263 Old Bellerica Rd., Bedford, Mass. 01730

[21] Appl. No.: 47,830

[22] Filed: Apr. 19, 1993

[51] Int. Cl.[5] ..... A47B 83/02

[52] U.S. Cl. ..... 297/142; 297/135

[58] Field of Search ..... 297/142, 141, 140, 135, 297/171; 108/26; 312/235.2; 248/240

[56] References Cited

U.S. PATENT DOCUMENTS 1,346,976 7/1920 Rankin ..... 297/142
2,339,647 1/1944 Meyer ..... 297/142 X
3,778,102 12/1973 Snyder et al. ..... 297/142 X

FOREIGN PATENT DOCUMENTS 1177824 4/1959 France ..... 297/142

*Primary Examiner*—Kenneth J. Dorner
*Assistant Examiner*—Milton Nelson, Jr.
*Attorney, Agent, or Firm*—William W. Jones

[57] ABSTRACT

An activity table has a plurality of stools movably connected thereto. The stools can be selectively moved between storage positions wherein they underlie the table, and deployed positions wherein they may be used by persons utilizing the table. The table is configured so that each stool is associated with a bipartite activity station, with adjacent activity areas. When a stool is moved to a storage position, the activity areas ordinarily associated with the stored stool can still be used by one in a wheelchair, so that the assembly is readily usable by the handicapped.

4 Claims, 2 Drawing Sheets

TABLE AND CHAIR ASSEMBLY

TECHNICAL FIELD

This invention relates to a table and chair assembly which provides a number of work or activity stations, each of which stations has an associated stool for one using the table to sit on. The stools are pivotally attached to the table so as to maintain the unitary nature of the assembly.

BACKGROUND ART

Unitary table and chair assemblies have been in use for many years. One very common form of such a table and chair assembly is a picnic table which has integral benches formed on each side of the table. Many variations on such a basic integral table and chair/bench/-stool/etc. assemblies have been suggested, and vary, from assemblies where the chair components are immobile relative to the table, to assemblies where the chair components are movable relative to the table, or can be disconnected from the table, to enhance the versatility of the assembly.

U.S. Pat. Nos. 3,109,678, granted Nov. 5, 1963 to K. H. Wilson; 3,348,879, granted Oct. 24, 1967 to A. Merola; 3,778,102, granted Dec. 11, 1973 to B. L. Snyder et al; 4,216,993, granted Aug. 12, 1980 to G. W. Shumaker; and 4,248,477, granted Feb. 3, 1981 to E. Netters, all disclose variations of unitary table and chair assemblies.

The Wilson patent discloses a table/chair assembly wherein the chair legs also serve as the legs for the table, and wherein the chairs can be folded up over the table to collapse the assembly for storage.

The Merola patent also discloses a table/chair assembly wherein the chair legs serve as table legs. The number of chairs in Merola can be varied, and the chairs can be detached from the table.

The Snyder et al patent discloses a table and chair structure wherein the chairs are pivotably connected to the table, and wherein the chairs also provide the legs for the table. The chairs in Snyder et al can be pivoted toward and away from the table, but cannot be pivoted completely beneath the table to a storage position.

The tables in the aforesaid prior art all have generally conventional round or rectangular configurations, and there is no easy handicapped access to the table/chair assemblies should one confined to a wheelchair need to use the assembly.

DISCLOSURE OF THE INVENTION

This invention relates to a table and chair assembly wherein the chairs are pivotally connected to legs of the table so that the chairs can be pivoted into operative deployed positions wherein persons using the table can be seated on the deployed chairs. The table is configured so as to provide bipartite activity areas for each chair. Each activity area has its own storage drawer in the table. The chairs can also be pivoted underneath the table to a storage position wherein they are out of the way, and do not interfere with one using the associated activity area in a wheelchair. The wheelchair can be moved right up to the table without interference from the stored chairs. When the chairs are pivoted beneath the table, they nest underneath the drawers so as not to obstruct access of the wheelchair components to the underneath side of the table.

It is therefore an object of this invention to provide a table and chair assembly wherein the chairs are movably connected to the table and shiftable relative thereto between storage positions and deployed positions.

It is a further object of this invention to provide a table and chair assembly of the character described wherein the table has a bipartite work or activity station associated with each deployed chair position.

It is an additional object of this invention to provide a table and chair assembly of the character described wherein the chair at each activity station can be moved beneath the table to a storage position which allows unimpeded access to that activity station for one confined to a wheelchair.

These and other objects and advantages of the invention will be more readily apparent from the following detailed description of a preferred embodiment thereof when taken in conjunction with the accompanying drawings, in which.

Figure 1:
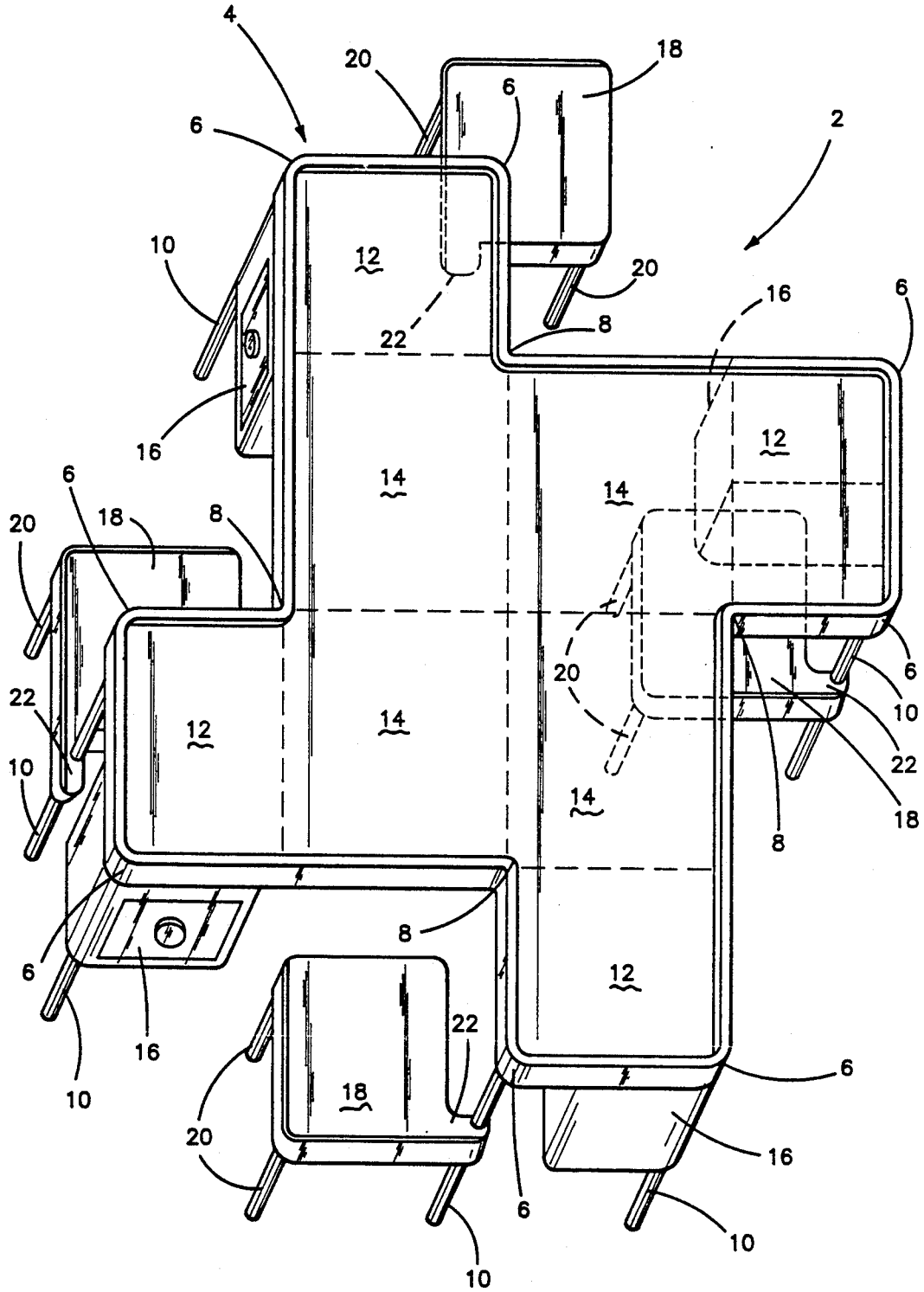
FIG. 1 is a perspective view of a preferred embodiment of a table/chair assembly formed in accordance with this invention.
Figure 2:
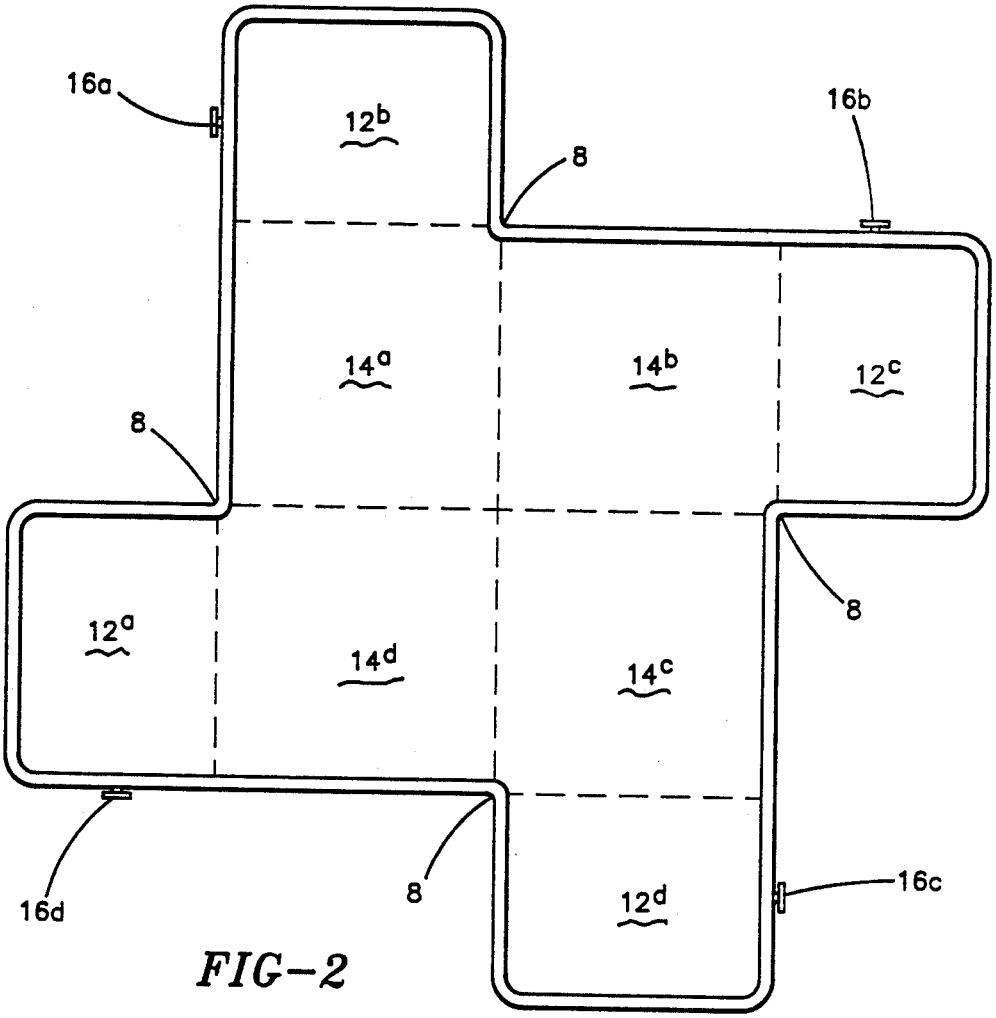
FIG. 2 is a plan view of the top surface of the table.

Referring now to the drawings, here is shown in FIG. 1 a preferred embodiment of the table/chair assembly, denoted generally by the numeral 2. The table 4 is formed with eight outer corners 6 and four inner corners 8. The table 4 is provided with a leg 10 at each of the outer corners 6, and the inner corners 8 are free of legs. Each of the outer corners 6 defines a peninsular work or activity station 12, each of which is diagonally adjacent to an associated activity station 14 in the centralmost part of the table 4. Each of the peninsular activity stations 12 has a supplies drawer 16 thereunder. The table 4 is thus divided into four pairs of diagonally associated activity stations 12 and 14, each of which flanks an inner corner 8 on the table 4; and each of which has its own supplies drawer 16. These associated activity stations and supply drawers are designated by the numerals $12^a$–$12^d$; $14^a$–$14^d$; and $16^a$–$16^d$ in FIG. 2.

Figure 3:
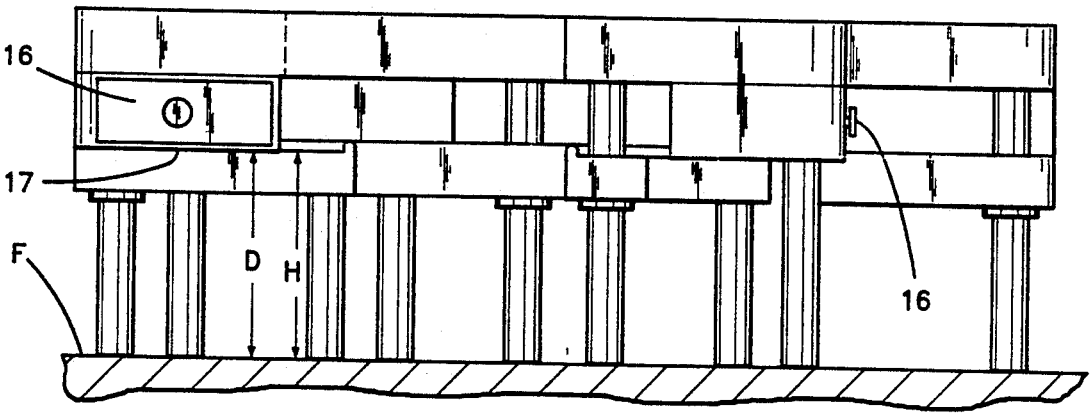
FIG. 3 is a side elevational view of the assembly showing all of the stools in their storage positions.

Each activity station 12, 14, 16 is provided with its own stool 18. Each stool 18 has a leg 20 at three of the stool's corners, and the fourth corner of each stool 18 is provided with a projection 22 through which one of the outer table legs 10 passes, whereby the stools 18 are all pivotably connected to the table 4. The height H of each of the stools 18 from the floor F (see FIG. 3) is slightly less than the distance D from the floor F to the bottom surface 17 of each drawer 16, so that each stool 18 can be pivoted in a clockwise direction (as seen in FIG. 1) to a storage position beneath one of the drawers 16, as shown on the righthand side of FIG. 1.

The table/chair assembly 2 of this invention is particularly useful in daycare or other school environments wherein children, including handicapped wheelchair-confined children, are present. Ambulatory children can use the assembly with the stools deployed outwardly facing the associated activity stations. Each child will have a pair of activity stations to use, along with a supplies drawer, as previously explained. In the event that a wheelchair-confined child wishes to use the assembly, one of the stools facing an activity area will be pivoted beneath the table so as to clear out the area beneath the non-peninsular of the two adjacent activity stations. Once the stool is pivoted to its storage position, a wheelchair can readily be moved up to the table so as to allow the child in the wheelchair to use the assembly in the same manner as a child sitting on one of the stools. The stools are easily movable between their deployed and storage positions, and cannot be accidentally separated from the table. The assembly occupies a minimum amount of space when all of the stools are moved to their storage positions, when the assembly is not in use.

Since many changes and variations of the disclosed embodiment of the invention may be made without departing from the inventive concept, it is not intended to limit the invention otherwise than as required by the appended claims.

What is claimed is:

1. A table and chair assembly comprising:

a) a table having a plurality of outwardly projecting right angle corners defining projecting peninsular work areas thereon, and inwardly projecting right angle corners between adjacent ones of said work areas, said table having one leg at each of said outwardly projecting corners, and being free of legs at each of said inwardly projecting corners; and b) a plurality of stools connected to said table, there being one stool pivotally connected to every other one of said table legs so that there are alternating stool-connected legs and intervening stool-free legs on said table, said stools being pivotally movable between deployed positions outward of each of said work areas, and storage positions beneath each of said work areas.

2. The assembly of claim 1 wherein said table includes a drawer assembly beneath each of said work areas, said drawer assemblies being interposed between each of said intervening stool-free legs and the adjacent inwardly projecting corner.

3. The assembly of claim 2 wherein said stools, when in said storage positions, are disposed beneath an adjacent one of said drawer assemblies.

4. The assembly of claim 2 further comprising inner work areas on said table which inner work areas are disposed between each of said drawer assemblies and said adjacent inwardly projecting corners, so that each inwardly projecting corner is flanked by one of said inner work areas and one of said peninsular work areas to provide each stool with a pair of mutually accessable work areas.

* * * * *